US008454818B2

(12) United States Patent
Filzwieser et al.

(10) Patent No.: US 8,454,818 B2
(45) Date of Patent: Jun. 4, 2013

(54) METHOD FOR OPERATING COPPER ELECTROLYSIS CELLS

(75) Inventors: Andreas Filzwieser, Proleb (AT); Iris Filzwieser, Proleb (AT)

(73) Assignee: Mettop GmbH, Leoben (AT)

( * ) Notice: Subject to any disclaimer, the term of this patent is extended or adjusted under 35 U.S.C. 154(b) by 543 days.

(21) Appl. No.: 12/675,601

(22) PCT Filed: Aug. 7, 2008

(86) PCT No.: PCT/AT2008/000277

§ 371 (c)(1),
(2), (4) Date: Apr. 6, 2010

(87) PCT Pub. No.: WO2009/026598

PCT Pub. Date: Mar. 5, 2009

(65) Prior Publication Data

US 2011/0056842 A1 Mar. 10, 2011

(30) Foreign Application Priority Data

Aug. 27, 2007 (AT) ..... A 1337/2007

(51) Int. Cl.
*C25C 1/12* (2006.01)
*C25C 7/00* (2006.01)
*C25C 7/06* (2006.01)

(52) U.S. Cl.
USPC ..... 205/674; 204/278.5; 204/237

(58) Field of Classification Search
USPC ..... 205/574
See application file for complete search history.

(56) References Cited

U.S. PATENT DOCUMENTS

| | | | | |
|---|---|---|---|---|
| 3,558,466 | A * | 1/1971 | Lebrizzi et al. | 204/278.5 |
| 3,682,809 | A * | 8/1972 | Marquardson et al. | 204/278.5 |
| 3,966,567 | A * | 6/1976 | Pace et al. | 205/353 |
| 4,581,115 | A | 4/1986 | Holzer | |
| 5,066,379 | A * | 11/1991 | Harry et al. | 204/279 |
| 5,492,608 | A | 2/1996 | Sandoval et al. | |
| 5,855,756 | A * | 1/1999 | Anzalone, III | 205/334 |

FOREIGN PATENT DOCUMENTS

| | | |
|---|---|---|
| BE | 771215 A1 | 12/1971 |
| DE | 87665 | 11/1972 |
| DE | 109031 | 10/1974 |
| DE | 125714 | 5/1977 |
| EP | 0146732 A2 | 7/1985 |

OTHER PUBLICATIONS

Lapicque et al, Modelling of a continuous parallel plate plug flow electrochemical reactor: electrowinning of copper, Journal of Applied Electrochemistry, vol. 15, 1985, pp. 925-935.*

Krishnae et al Enhancement of operating current density in a copper electrowinning cell, Hydrometallurgy, vol. 31, 1992, pp. 243-255.*

* cited by examiner

*Primary Examiner* — Harry D Wilkins, III
(74) *Attorney, Agent, or Firm* — Workman Nydegger

(57) ABSTRACT

In a process for the operation of copper electrolysis cells including a plurality of anode and cathode plates arranged vertically and parallel to each other, a longitudinal electrolyte inflow and an electrolyte outflow, the electrolyte is injected via the electrolyte inflow horizontally and parallel to the electrodes in each electrode gap always at the height of the lower third of the electrodes at a speed of from 0.3 to 1.0 m/s, with the cathode plates being arranged stationarily relative to the inflow direction. As a result, an optimized flow guidance of the electrolyte with regard to the electrodes is achieved, resulting in an increase in the limiting current density.

19 Claims, 6 Drawing Sheets

METHOD FOR OPERATING COPPER ELECTROLYSIS CELLS

The invention relates to a process for the operation of copper electrolysis cells comprising a plurality of anode and cathode plates arranged vertically and parallel to each other, a longitudinal electrolyte inflow and an electrolyte outflow, as well as to a new copper electrolysis cell.

In principle, copper in the form of copper(II)ions is solubilized anodically in a copper electrolysis and precipitates on the cathode to form again metallic copper.

Anode: $Cu \rightarrow Cu^{2+} + 2\ e^-$

Cathode: $Cu^{2+} + 2\ e^- \rightarrow Cu$

The amount of metallic copper can be determined via Faraday's law (equation 1):

$$m = \frac{M \cdot i \cdot A \cdot t}{z \cdot F} \qquad \text{Equ. 1}$$

Therein, m is the mass of copper produced in g, M is the molar mass of copper in g/mol, i is the current density in $A/m^2$, A is the electrode surface in $m^2$, t is the time in s, z is the valency of the ions involved in the reaction and F is the Faraday constant in As/mol. If it is desired to increase the amount of copper produced with a given plant size (A), only the current density i can be increased.

The current densities which today are technically feasible, e.g., in a Cu refining electrolysis, amount to, at most, 350 $A/m^2$. This value results from the fact that, in a technical electrolysis cell, only about 30-40% of the theoretical limiting current density can be run. This theoretical limiting current density $i_{Limit}$ (Equation 2) is a function of the copper ion concentration in the electrolyte ($c^0$) and the diffusion layer thickness $\delta_N$ at the electrode. N, the number of ions involved in the process, F, the Faraday constant and D, the diffusion coefficient, are constant.

$$i_{Limit} = n \cdot F \cdot D \cdot \frac{c^0}{\delta_N} \qquad \text{Equ. 2}$$

The calculation of the theoretical current density yields, with contemporary configurations, values of about 1000 $A/m^2$ and hence technical current densities of, at most, 350 $A/m^2$.

Higher current densities lead to occurrences of dendritic formation and finally electrical short circuits between the anode and the cathode, which reduces the efficiency for the precipitation of cathode copper as well as the cathode quality. In order to be able to adjust a substantially higher current density, the limiting current density must be increased. This is possible essentially only by reducing the Nernst diffusion layer thickness. This reduction can be achieved by a higher relative motion between the electrolyte and the electrode.

The configurations of refining electrolysis cells which are used today are characterized in that the electrolyte is supplied on the front side and discharged on the opposite front side. The main flow thus occurs between the cell wall and the electrodes or the cell bottom and the lower edges of the electrodes, respectively. This flow applied from the outside (also referred to as a forced convection) has only a minor influence on the flow conditions between the electrodes. The flow between the electrodes is determined by the natural convection resulting from the density differential of the electrolyte in front of the cathodes (lighter electrolyte due to the depletion of copper ions) and in front of the anodes (heavier electrolyte due to the accumulation of copper ions), respectively.

Therefore, apart from electrolysis cells exhibiting the transverse flow principle, cells in which the electrolyte flows mainly parallel to the surfaces of the electrodes have also been proposed.

So-called channel cells have been developed in which a parallel flow is applied at a relatively high speed, wherein screen-shaped flow-rate fixtures are necessary in the electrolyte inflow part in front of the electrode groups in order to ensure a uniform flow distribution across the entire channel cross-section.

Parallel flow cells with double-walled partition walls are likewise known, wherein one wall is flush with the upper bath edge, but does not reach the bath bottom, whereas the other wall starts at the bath bottom, but does not reach the upper edge.

In another well-known electrolyte bath (DD 87 665), double- or also multiple-walled partition walls with openings distributed across the entire width are arranged, which are located, on one side, at the height of the lower cathode edge and/or slightly upwards and, on the other side, at the height of the electrolyte level and/or slightly downwards.

Furthermore, containers for electrolytic metal production are known in which, in order to achieve a parallel flow, the electrolyte inflow and outflow into and from the electrode space, respectively, occur through perforated plates arranged parallel to the longitudinal walls.

In a different cell structure, a parallel partition wall with openings for the electrolyte passage into the electrode space is arranged on only one longitudinal wall. The through openings are distributed across the entire electrode height and are oriented toward the electrode gaps.

Furthermore, for achieving a parallel flow, guiding fixtures on the longitudinal walls of the cell have been proposed, through which the electrolyte is guided around the electrodes in a serpentine manner.

A comparatively simple measure for achieving a parallel flow in conventional electrolysis cells consists in the arrangement of tubular electrolyte inflow and outflow devices through which the electrolyte in the two free spaces between the longitudinal bath walls and the lateral electrode edges is guided in opposite directions. Due to the larger cathode width, a congestion of the electrolyte occurs in front of the lateral cathode edges, whereby said electrolyte flows partly into the respective electrode gap.

An electrolyte bath is also known in which the parallel flow is achieved via an inflow of the electrolyte from the bath bottom. Here, the electrolyte inflow openings are located beneath the anodes and are oriented vertically upwards.

In DD 109 031, an electrolysis cell having a longitudinal electrolyte inflow is described, wherein an electrolyte inflow box running across the entire bath length, extending as far as slightly underneath the lower cathode edge, closed at the bottom and on the sides, open above the electrolyte level is mounted to one or both longitudinal sides, which electrolyte inflow box comprises through openings on the side facing the electrodes, which through openings are oriented horizontally and parallel to the electrodes and extend across a certain area of the cathode gaps in the area of the lower cathode edges. According to one embodiment, the cross-sectional area of all through openings is smaller than the open horizontal cross-sectional area on the top side of the electrolyte inflow box in order to achieve a slight overpressure.

However, the above-mentioned parallel flow cells have numerous disadvantages, for which reason they have so far not been able to prevail against transverse flow cells.

For example, the channel cell requires a high pumping capacity in order to achieve high flow velocities. For separating the entrained anode sludge, continuous electrolyte filtration is required.

Similarly, electrolyte inflow openings in the bath bottom are unsuitable because of the risk of anode sludge being whirled up.

Despite lower flow velocities, substantial current branchings may also occur in parallel flow cells with simple partition walls. In addition, the arrangement of the electrolyte outflow and inflow, respectively, on the bath bottom likewise involves the risk of anode sludge being whirled up and hence of a deterioration of the cathode quality. Such a risk also exists when double-walled partition walls are arranged, of which in each case one does not reach the bath bottom. Besides, unfavourable conditions for the mixing of bath and fresh electrolytes emerge. A further disadvantage is the strain on such double-walled partition walls. For example, these walls must have a particularly stable design for the receiving of anode loads, which, however, is associated with substantial material problems.

In parallel flow baths with double- or multiple-walled partition walls, improved flow conditions are indeed achieved because of the arrangement of row-shaped openings at the height of the lower cathode edge and slightly above as well as at the height of the electrolyte level and slightly underneath, but the same material problems as above exist. Moreover, areas with only a slight electrolyte movement, in which encrustations may occur, are present in the double- or multiple-walled partition walls.

Among known parallel flow cells with separate electrolyte inflow and outflow, the container equipped with perforated plates is unusable, since the desired parallel flow cannot be realized because of the density differentials between the bath electrolyte and the warmer inflow electrolyte and the preconditions for a sufficient sedimentation of anode sludge do not exist.

In the proposed electrolyte bath with only one perforated partition wall on the electrolyte inflow side, the flow conditions are unsatisfactory for the same reasons. Due to the independent partition wall which has a relatively strong design, the bath width increases substantially, which involves a larger space requirement.

The insertion of guiding fixtures as flow converters as well as the arrangement of appropriately shaped partition walls involve very high expenditures with regard to the material and the manufacturing. In addition, hanging the electrodes into these baths requires great carefulness, since the desired electrolyte circulation is ensured only if the required geometric conditions are precisely met.

The present invention aims to avoid the above-mentioned disadvantages and problems of the prior art and has as its object to provide a process for operating (conventional) copper electrolysis cells as well as a copper electrolysis cell, by means of which higher current densities and hence higher current yields than in the prior art are possible, but the cathode quality is not impaired, e.g., by the anode sludge being whirled up, a disturbance in the anode sludge precipitation or a poor inhibitor distribution. Similarly, extensive changes to the cell and expensive installations in the cell are to be avoided.

In a first aspect, said object is achieved in a process of the initially mentioned kind in that the electrolyte is injected via the electrolyte inflow horizontally and parallel to the electrodes in each electrode gap always at the height of the lower third of the electrodes at a speed of from 0.3 to 1.0 m/s, with the cathode plates being arranged stationarily relative to the inflow direction.

As a result, an optimization of the flow guidance in the electrolysis cell based on a maximum relative motion from the electrolyte to the electrode is achieved, which advantageously results in a reduction of the hydrodynamic boundary layer, an equalization of the concentration and temperature of the electrolyte, a better distribution of the inhibitors and, above all, an increase in the limiting current density.

FIGS. 1*a*-1*c* are graphs illustrating velocity distribution of electrolyte flow between electrodes.

Figure 1A:
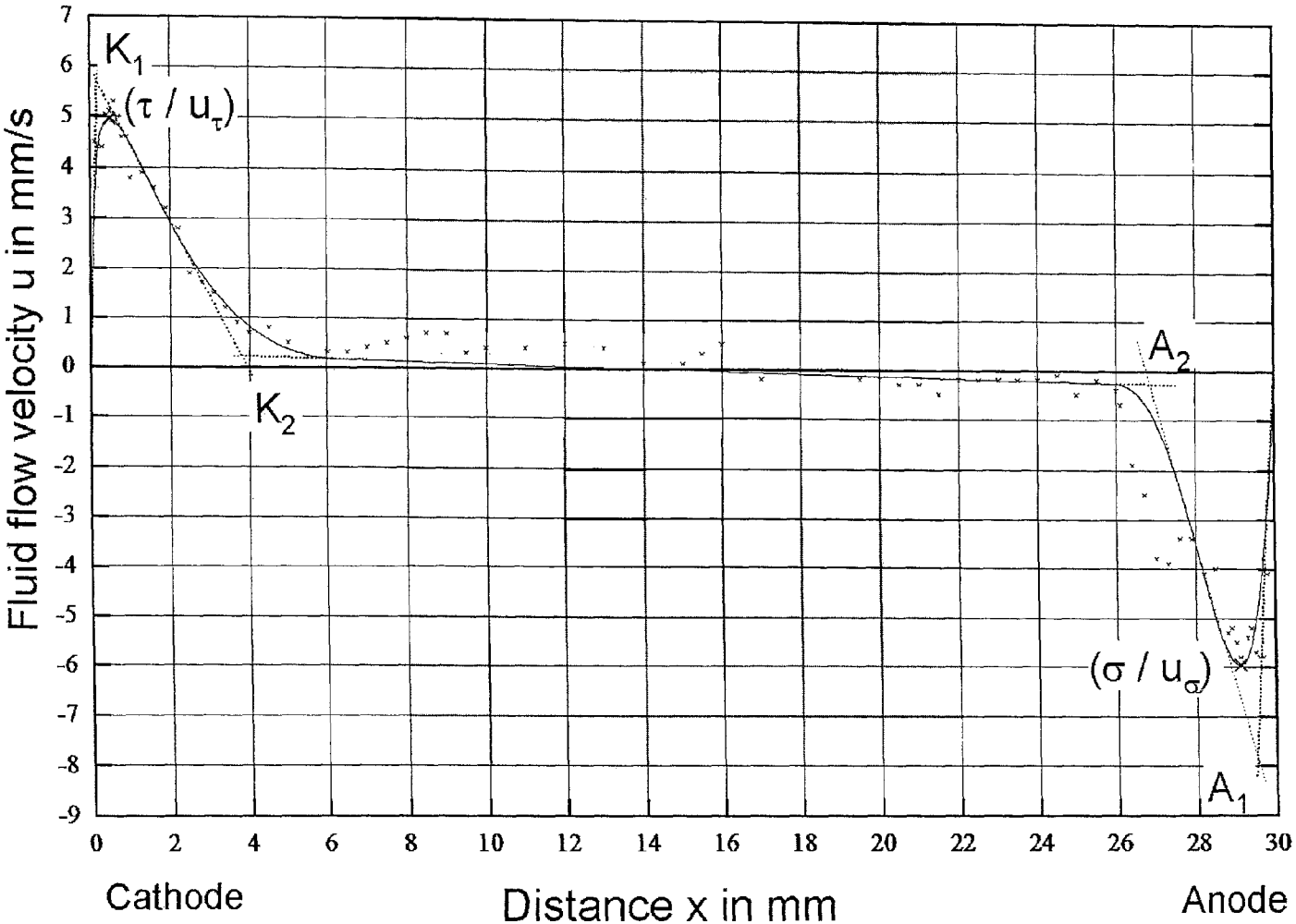
Figure 1B:
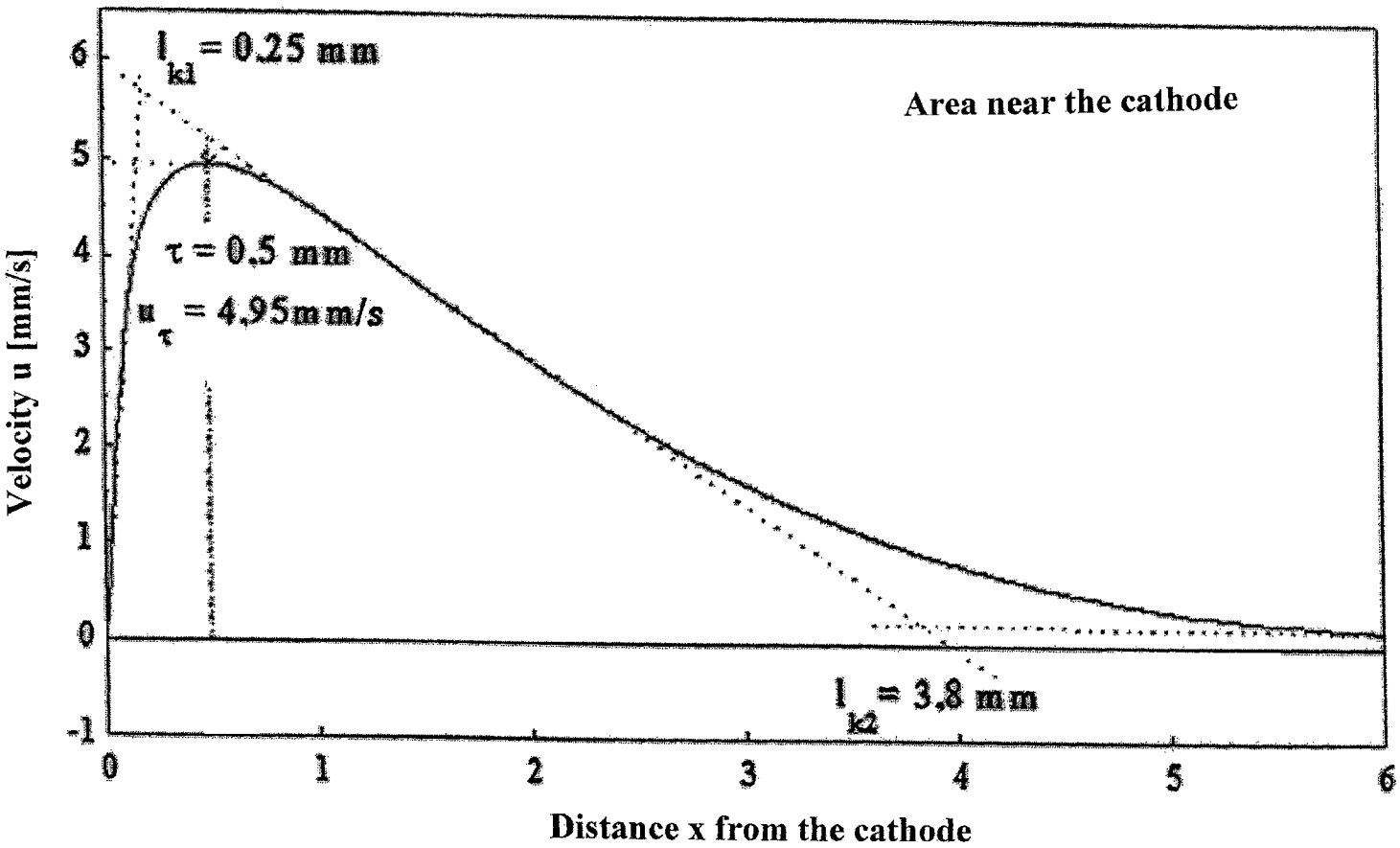
Figure 1C:
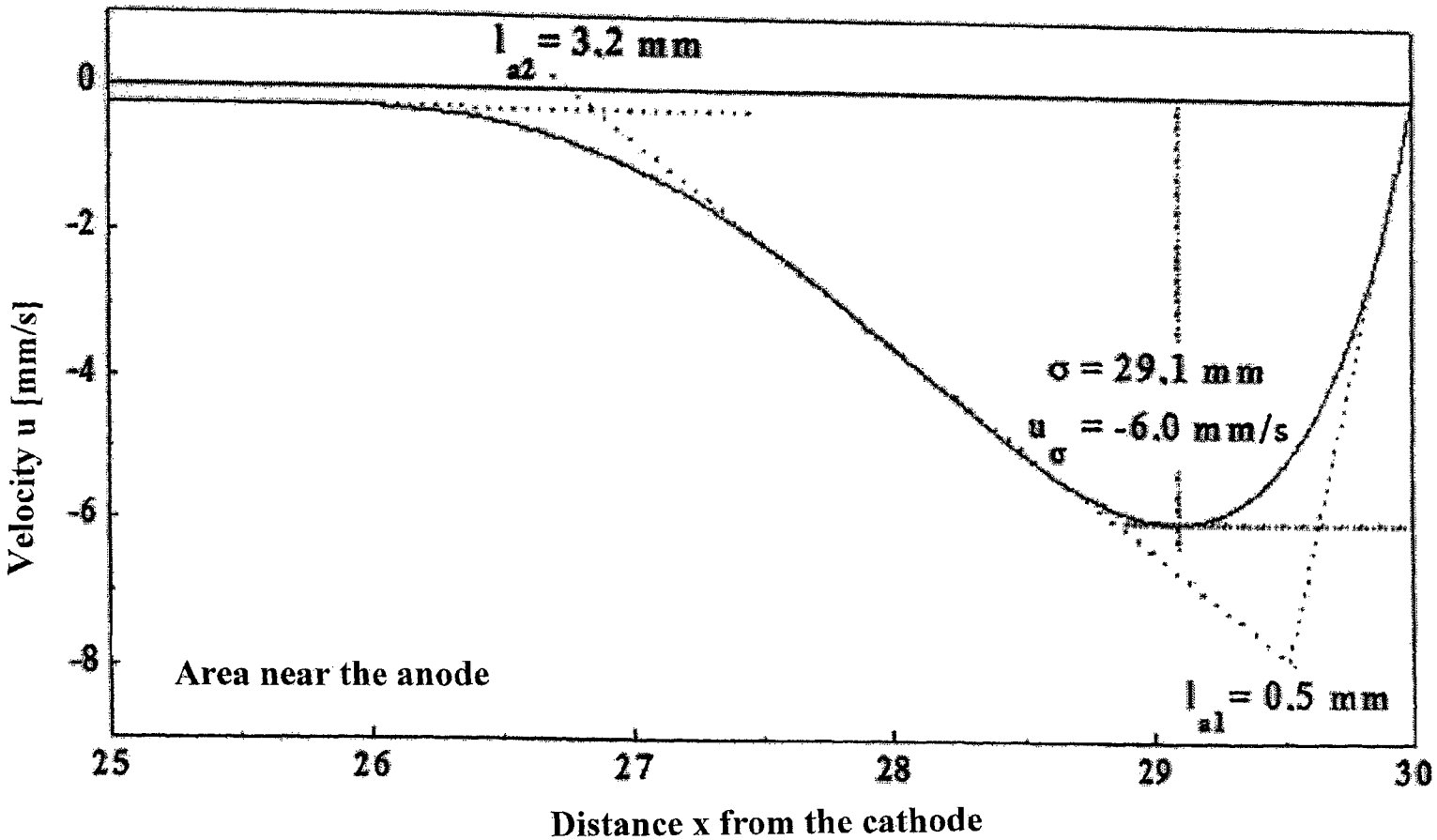

Between the anode and the cathode, an upward movement of the electrolyte occurs near the cathode and a downward movement occurs near the anode as a result of the natural convection. A velocity distribution as shown in FIG. 1 exists between the electrodes. The higher electrolyte velocity in close proximity to the cathode surface leads to an improved and/or increased precipitation of copper on the cathode, whereas the reduced velocity on the anode surface simultaneously promotes the settling of the anode sludge.

In a preferred embodiment, the electrolyte is injected into the cell at a speed of from 0.3 to 0.6 m/s.

A further improvement of the process is possible if the electrolyte is not allowed to flow out on the front side of the cell, as it is common and used in the examples, but on the longitudinal side.

In particular, the process according to the invention has the additional advantage that it can be performed also in already existing electrolysis cells without major effort and with few changes to the existing equipment.

According to another aspect of the invention, a copper electrolysis cell comprising a plurality of anode and cathode plates arranged vertically and parallel to each other, a longitudinal electrolyte inflow and an electrolyte outflow is provided, which is characterized in that the electrolyte inflow comprises a closed inflow box extending along a longitudinal wall of the cell as far as into the area of the lower electrode edge, which inflow box can be hooked in on the front sides of the cell and is connectable to an electrolyte source and is provided with means for the stationary arrangement of each cathode plate as well as, in the areas extending across the lower third of the electrode height and, in each case, corresponding to the electrode gap, with at least one opening, in particular nozzle, for a directed electrolyte supply.

Preferably, the means for the stationary arrangement of the cathode plates are designed as means for vertical guidance.

According to a preferred embodiment, the means for vertical guidance are designed as circular disks or wheels, with the cathode plates, in each case, being centered between two disks or wheels, respectively, arranged adjacent to each other and spaced apart from each other.

According to a possible design of the electrolysis cell, the electrolyte outflow is arranged on the front side. Advantageously, however, it may also be arranged on the longitudinal side.

The electrolyte inflow box used in the cell according to the invention is usable advantageously also in already existing conventional electrolysis cells.

Below, the invention is illustrated in further detail by way of examples as well as the drawing.

Figure 2:
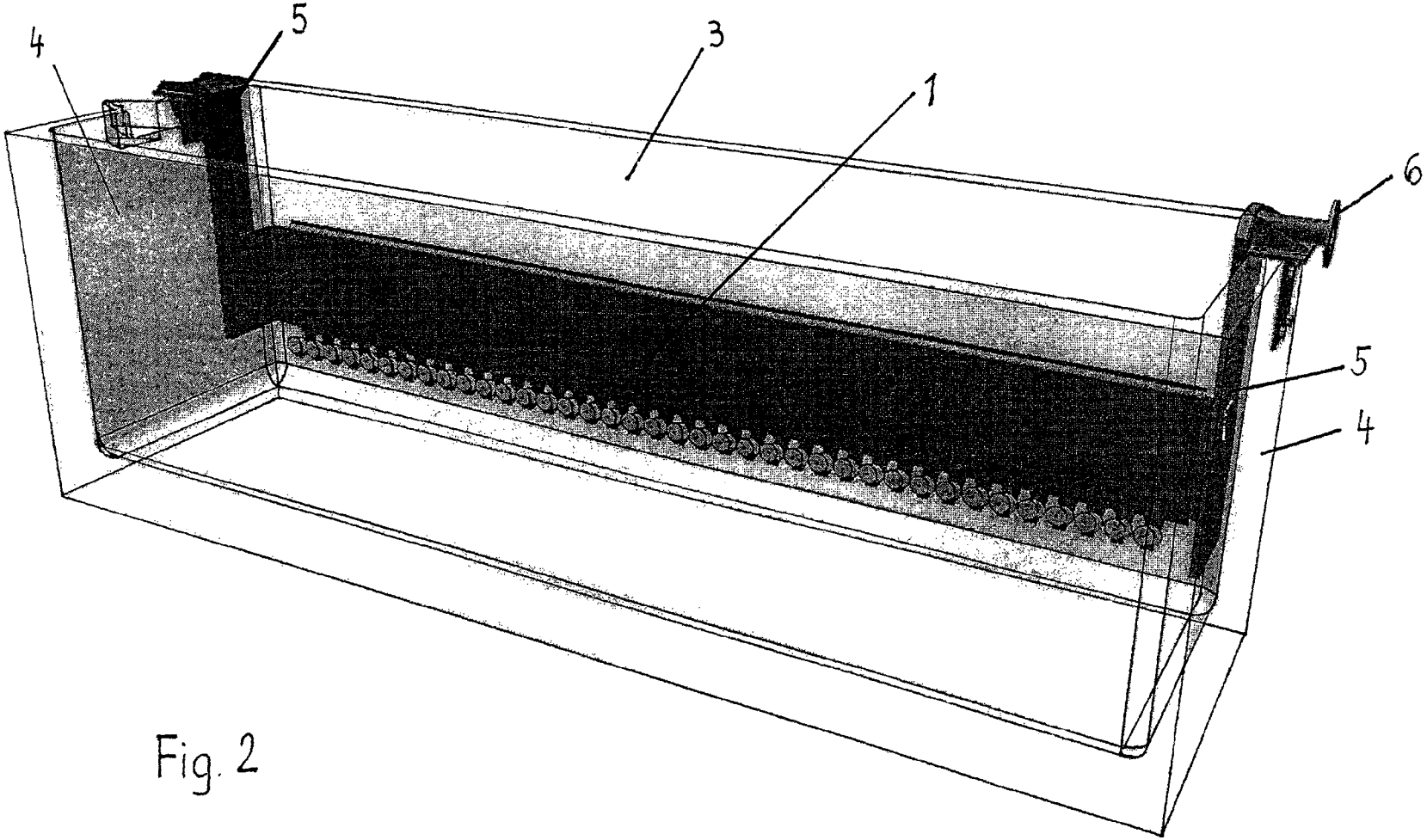
FIG. 2 is a schematic illustration of a copper electrolysis cell.

FIG. 2 shows a schematic illustration of a copper electrolysis cell according to the present invention, in which, for the sake of better distinguishability, the electrolyte inflow box according to the invention has been emphasized graphically in relation to the electrolysis cell itself. The closed inflow box 1 extends along a side wall 3 of the bath 2 and is fixably hooked into the cell at the front walls 4 of the bath 2, with the hooking devices 5 serving simultaneously for the supply and removal of the electrolyte into and from the actual inflow box. At the end of a hooking device 5, the inflow box 1 is connectable to an electrolyte source, e.g., via a flange joint 6.

Figure 3:
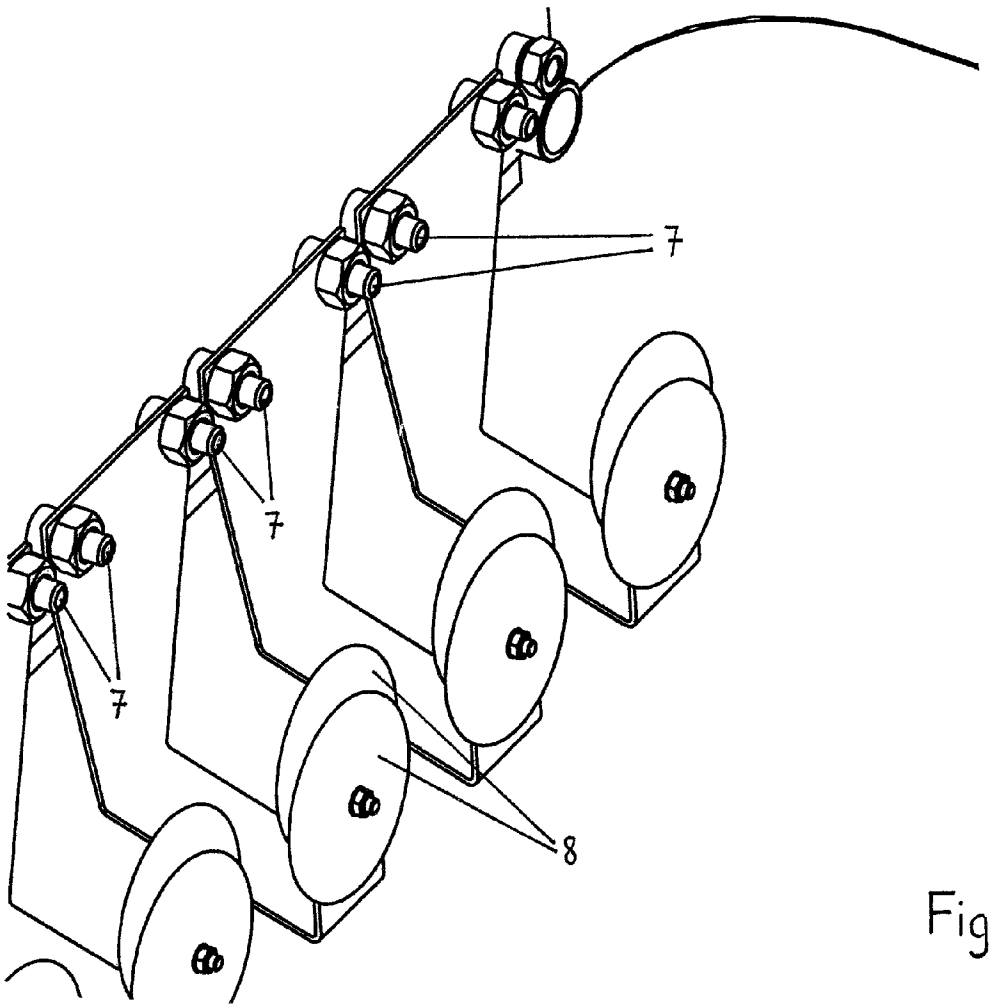
FIGS. 3 and 4 illustrate an embodiment of an arrangement of nozzles and cathode plates of an electrolysis cell.

The inflow box 1 is arranged so deep in the cell that it extends as far as into the area of the lower electrode edge. In the lower area of the inflow box 1, openings, in particular nozzles 7, facing the electrodes are arranged, with at least one opening being located in each area corresponding to the electrode gap and extending across the lower third of the electrode height (FIG. 3). Through these openings, the electrolyte is injected into the cell in the lower area of the electrode gap at a speed of from 0.3 to 1.0 m/s in order to obtain the advantageous flow guidance mentioned further above. However, since this effect is achieved only with a defined and actually maintained arrangement of the electrodes relative to the inflow direction, which can hardly be accomplished if the electrodes are hooked into the bath in a conventional way, it is essential to arrange the cathode plates stationarily relative to the inflow direction. For this purpose, means for the stationary arrangement of each cathode plate are provided in the electrolysis cell, more precisely on the inflow box 1.

Figure 4:
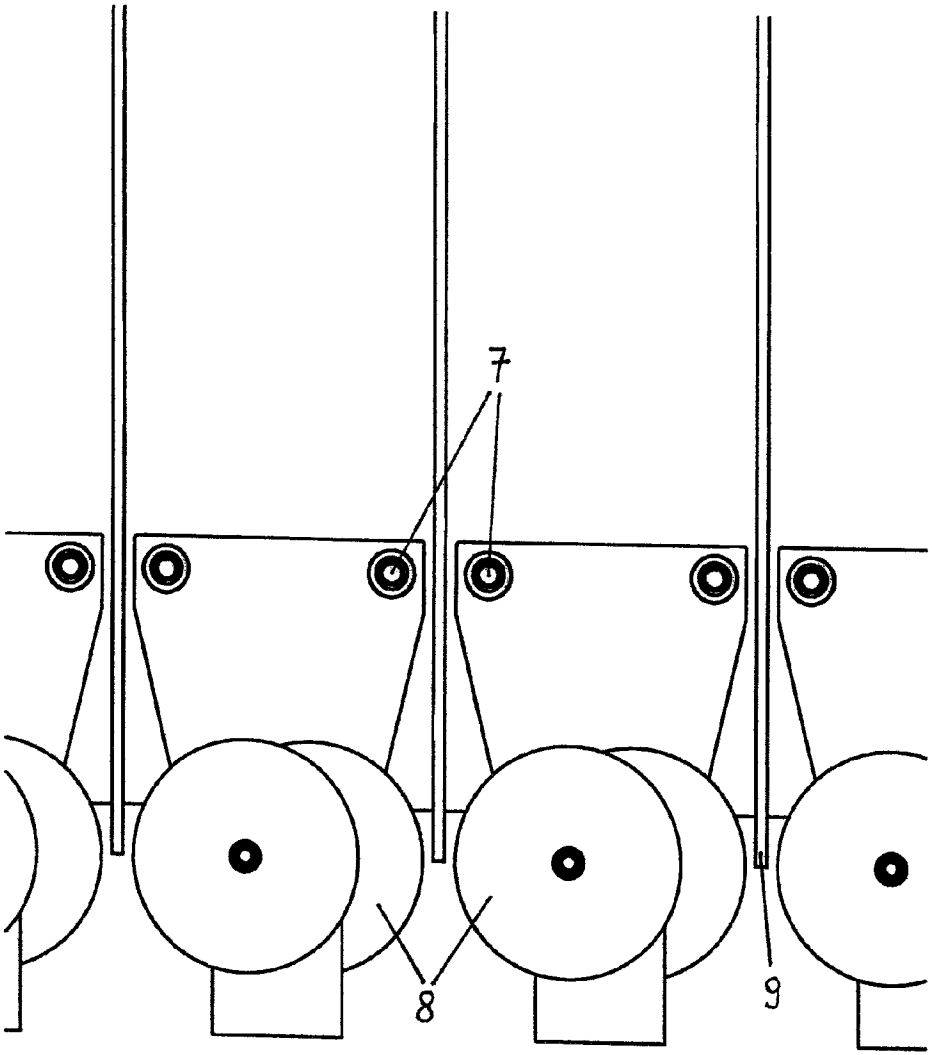

In the embodiment illustrated in FIG. 3, the stationary arrangement is achieved by means for the vertical guidance of the cathode plates which are designed as circular disks or wheels 8, with the cathode plates 9, in each case, being centered between two disks or wheels, respectively, arranged adjacent to each other and spaced apart from each other (FIG. 4). However, a person skilled in the art will be aware of many other embodiments or will be able to find them easily based on his or her specialized knowledge.

EXAMPLES

For the subsequent examples, a conventional industrial copper electrolysis cell has been equipped with an electrolyte inflow according to the invention comprising an inflow box as described above.

Example 1

Copper sheets were produced in an industrial electrolysis cell with an inflow speed of 0.75 m/s and a current density of 407 A/m$^2$. During the entire anode period, the cathodic current yield was more than 97%.

Example 2

Copper sheets were produced in an industrial electrolysis cell with an inflow speed of 1.0 m/s and a current density of 498 A/m$^2$. During the entire anode period, the cathodic current yield was more than 93%.

Example 3

Copper sheets were produced in an industrial electrolysis cell with an inflow speed of 0.5 m/s and a current density of 498 A/m$^2$. During the entire anode period, the cathodic current yield was more than 98%.

Example 4

Copper sheets were produced in an industrial electrolysis cell with an inflow speed of 0.67 m/s and a current density of 543 A/m$^2$. During the entire anode period, the cathodic current yield was more than 95%.

In Table 1, the operational conditions and results of further trials are indicated.

TABLE 1

| Trial No. | i in A/m$^2$ | Q in l/min | v in m/s | η 1 period in % | η 2 period in % |
|---|---|---|---|---|---|
| 1 | 407 | 75 | 0.75 | 93.92 | 95.01 |
| 2 | 407 | 75 | 0.5 | 97.24 | 98.15 |
| 3 | 407 | 75 | 0.5 | 99.46 | 98.35 |
| 4 | 407 | 75 | 0.5 | 97.49 | 96.27 |
| 4a | 407 | 75 | 0.5 | 92.1 | 93.77 |
| 5 | 498 | 150 | 1 | 98.99 | 93.47 |
| 6 | 498 | 75 | 0.5 | 99.55 | 99.28 |
| 7 | 498 | 100 | 0.67 | 99.53 | 99.13 |
| 8 | 543 | 100 | 0.67 | 98.18 | 97.59 |

The invention claimed is:

1. A process for the operation of copper electrolysis cells comprising a plurality of anode and cathode plates arranged vertically and parallel to each other, a longitudinal electrolyte inflow and an electrolyte outflow, the process comprising:

injecting electrolyte via the electrolyte inflow horizontally and parallel to electrodes in each electrode gap at a maximum height corresponding to a lower third of the electrodes and at a speed of from 0.3 to 1.0 m/s, with the cathode plates being arranged stationarily relative to the inflow direction.

2. A process according to claim 1, wherein the electrolyte is injected into the cell at a speed of from 0.3 to 0.6 m/s.

3. A process according to claim 1, wherein the electrolyte is allowed to flow out on a longitudinal side of the copper electrolysis cells.

4. A process according to claim 2, wherein the electrolyte is allowed to flow out on the longitudinal side.

5. A process according to claim 1, wherein the copper electrolysis cells further include circular disks or wheels, with each cathode plate, in each case, being centered between two disks or wheels, respectively, arranged adjacent to each other and spaced apart from each other.

6. A process according to claim 5, wherein the electrolyte outflow is arranged on a front side of the copper electrolysis cells.

7. A process according to claim 5, wherein the electrolyte outflow is arranged on a longitudinal side of the copper electrolysis cells.

8. A copper electrolysis cell comprising a plurality of anode and cathode plates arranged vertically and parallel to each other, a longitudinal electrolyte inflow and an electrolyte outflow, wherein the electrolyte inflow comprises a closed inflow box extending along a longitudinal wall of the cell and into an area of a lower electrode edge, wherein the inflow box is configured to be hooked in on one or more front sides of the cell and is connectable to an electrolyte source and is provided with means for stationary arrangement of each cathode plate and, only in areas extending across a lower third of an electrode height and, in each case, corresponding to an electrode gap, the inflow box includes at least one opening configured for a directed electrolyte supply in order that electrolyte injected by the inflow box is only injected at a location within the cell corresponding to a lower third of the electrode.

9. A copper electrolysis cell according to claim 8, wherein the means for the stationary arrangement of each cathode plate is designed as means for vertical guidance.

10. A copper electrolysis cell according to claim 9, wherein the means for vertical guidance are designed as circular disks or wheels, with each cathode plate, in each case, being centered between two disks or wheels, respectively, arranged adjacent to each other and spaced apart from each other.

11. A copper electrolysis cell according to claim 10, wherein the electrolyte outflow is arranged on the front side.

12. A copper electrolysis cell according to claim 10, wherein the electrolyte outflow is arranged on a longitudinal side.

13. A copper electrolysis cell according to claim 9, wherein the electrolyte outflow is arranged on the front side.

14. A copper electrolysis cell according to claim 9, wherein the electrolyte outflow is arranged on a longitudinal side.

15. A copper electrolysis cell according to claim 8, wherein the electrolyte outflow is arranged on the front side.

16. A copper electrolysis cell according to claim 8, wherein the electrolyte outflow is arranged on a longitudinal side.

17. A copper electrolysis cell according to claim 8, wherein the at least one opening is a nozzle.

18. An electrolyte inflow box for a copper electrolysis cell, which inflow box is closed and extends along a longitudinal wall of the cell as far as into an area of a lower electrode edge, wherein the inflow box is configured to be hooked in on one or more front sides of the cell and is connectable to an electrolyte source and is provided with means for stationary arrangement of each cathode plate and, only in areas extending across a lower third of an electrode height and, in each case, corresponding to an electrode gap, the inflow box includes at least one opening configured for a directed electrolyte supply in order that electrolyte injected by the inflow box is only injected at a location within the cell corresponding to a lower third of the electrode.

19. An electrolyte inflow box according to claim 18, wherein the at least one opening is a nozzle.

* * * * *